US005907935A

United States Patent [19]

Elena

[11] Patent Number: 5,907,935

[45] Date of Patent: Jun. 1, 1999

[54] ADJUSTABLE MODULAR STAIRCASE

[76] Inventor: Paul Philemon Elena, Quartier des Sleves, 83300 Draguignan, France

[21] Appl. No.: 08/913,563

[22] PCT Filed: Mar. 15, 1996

[86] PCT No.: PCT/FR96/00399

§ 371 Date: Sep. 16, 1997

§ 102(e) Date: Sep. 16, 1997

[87] PCT Pub. No.: WO96/29488

PCT Pub. Date: Sep. 26, 1996

[30] Foreign Application Priority Data

Mar. 17, 1995 [FR] France ..... 95 03446

[51] Int. Cl.[6] ..... E04F 11/00

[52] U.S. Cl. ..... 52/182; 52/183; 52/188; 256/65; 256/67

[58] Field of Search ..... 52/182, 183, 184, 52/185, 188; 256/59, 60, 65, 67

[56] References Cited

U.S. PATENT DOCUMENTS

| | | | |
|---|---|---|---|
| 3,430,729 | 3/1969 | Miceii . | |
| 5,123,210 | 6/1992 | Schmidt | 52/182 |
| 5,134,820 | 8/1992 | Liu | 52/183 |
| 5,167,102 | 12/1992 | Nakatsubo et al. | 52/183 X |
| 5,502,933 | 4/1996 | Skillern | 52/182 |
| 5,636,483 | 6/1997 | Wille | 52/183 X |

FOREIGN PATENT DOCUMENTS

| | | | |
|---|---|---|---|
| 2 691 489 A1 | 11/1993 | France . | |
| 23 32 806 A1 | 1/1975 | Germany . | |
| 26 19 804 A1 | 11/1977 | Germany . | |
| 2 114 182 | 8/1983 | United Kingdom . | |
| 2145751 | 4/1985 | United Kingdom | 52/184 |

*Primary Examiner*—Carl D. Friedman
*Assistant Examiner*—Timothy B Kang
*Attorney, Agent, or Firm*—Adams Law Firm, P.A.

[57] ABSTRACT

The present invention concerns a modular and adjustable staircase, prefabricated, destined to be installed in a rigid manner, and having at least one side which is equipped with a stiffener (1). Per stair and per side having a stiffener (1), a single element of the staircase, which is a crosspiece equipped with a heel (7*a*), of a shim (6), must be adjusted or is predetermined is order to obtain the desired stair height.

18 Claims, 5 Drawing Sheets

ADJUSTABLE MODULAR STAIRCASE

This application is a national stage application, according to Chapter II of the Patent Cooperation Treaty.

TECHNICAL FIELD AND BACKGROUND OF THE INVENTION

The present invention concerns a modular and adjustable staircase, prefabricated, designed to be installed in a rigid manner, and having at least one side which is equipped with a stiffener. Per stair and per side having a stiffener, a single element of the staircase, which is a cross piece with a heel, or a shim, must be adjusted or is predetermined in order to obtain the stair height desired. The shim is an element that is placed under the bottom side of the crosspiece to adjust the height of the step. The crosspiece with heel is a one piece element which likewise determines the height of the step.

Definitions of the terms used in the description and the claims:

floor to floor spacing: the space which separates the levels of a storey, that is, the vertical distance between the upper floor and the lower floor of the place where the present invention is to be installed.

rear of a stair: the part opposite the nosing.

tread: the horizontal spacing between two stair nosings, measured along the line of stride.

width of a stair: horizontal spacing which is perpendicular to the tread, measured between the stair extremities.

height of a stair: vertical distance between the level of the lower floor and the first stair, or between two consecutive stairs, or between the last stair and the level of the upper floor.

constant stair height: height obtained by dividing the floor to floor spacing by the number of stairs plus one.

The present invention, tending to bring improvements to patent #92 06170 published under #2691 489, differs from the prior techniques by its possibility for adjusting the heights of stairs and/or the tread and/or the width of each stair, which makes the staircase multi-purpose and suitable for installing in spaces with dissimilar volumes.

Thus the installation of the staircase can form only constant stair heights. Most of the known manufactured staircases require a staircase starting base which can be cut off at the top; which, compared to the vertical spacing of the other stairs shows a disparity in height which is detrimental to the climbing or descending cadence of the user. The base makes the structure uncomfortable and dangerous because of this disparity in height.

Patent DE-A-2619804 filed by the Carl Rehfeldt cement factory, describes several configurations for prefabricated staircases designed to be built using fiberglass-reinforced concrete. Contrary to the present invention, the various configurations described, as well as their manner of production, allow neither an adjustment of the geometry of a type of element of the prefabricated staircase, nor a choice of position and orientation of certain of the elements of the staircase in relation to one other in order to result in a possible in situ adjustment of the height and tread of the stairs, whereas the present invention allows all of that.

DESCRIPTION OF THE PREFERRED EMBODIMENT AND BEST MODE

According to a specific embodiment, the present invention is a staircase installed between two floor levels (FIG. 1).

In the figure we see a stiffening element (1) connected to the vertical piece (3B) serving as the lower newel and to the upper newel (3E), as well as vertical pieces (4A, 4A1, 3B) traversing peripheral modules (12) and connected to the crosspieces with a heel (7*a*) or shim (6) equipping a crosspiece (7), which support stairs (5, 16).

There are three types of vertical pieces (4A, 4A1, 3B) attached to stiffener (1), which might be rectangular in cross section with rounded edges. The bottoms of vertical pieces (4A, 4A1) are perforated with two superimposed vertical slits (9*a*, 9*b*) (FIG. 2) of different heights. The upper slit (9*a*) is of the high type with respect to slit (9*b*).

BRIEF DESCRIPTION OF THE DRAWINGS

Some of the objects of the invention have been set forth above. Other objects and advantages of the invention will appear as the description proceeds when taken in conjunction with the following drawings, in which.

Vertical piece (3B) is perforated in its lower part by a slit (9*a*) of the high type.

Figure 1:
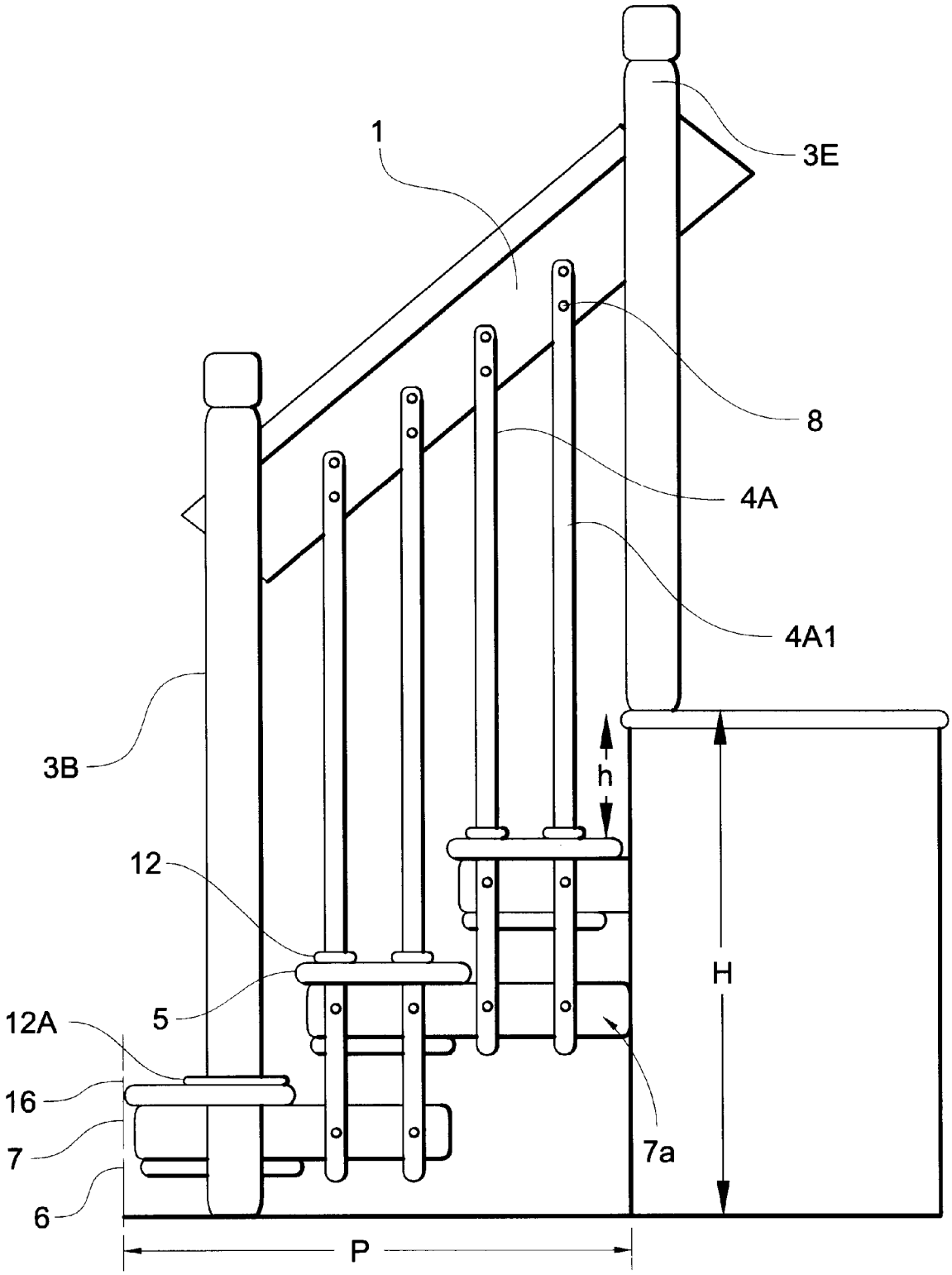
FIG. 1 is an elevational view of an adjustable modular staircase according to one preferred embodiment of the present invention.

Vertical piece (4A1) is different from vertical piece (4A) by its slightly longer length. The center distances of the axes of slits (9*a*) and (9*b*) are identical on both vertical pieces of unequal height. At the level of each slit (9*a*, 9*b*) are provided, perpendicularly to their axes, superimposed perforations (14) placed in such a way as to allow the passage of the fastening components, which may be trunnions (FIG. 1).

The specific form or crosspieces (7*a*) and crosspieces (7) equipped with shims (6) allows adjustment of the tread and the height of each stair.

The crosspieces fit into the upper slit (9*a*) (FIG. 2) of vertical pieces (4A, 4A1) or in the lower slit of vertical piece (3B).

The lower part of the said crosspieces (7*a*) includes a heel, which is a projecting part, or a shim (6) which rests upon the lower part of slit (9*a*) of each vertical piece. Each slit (9*b*) rests upon part of each crosspiece (7, 7*a*).

Figure 3:
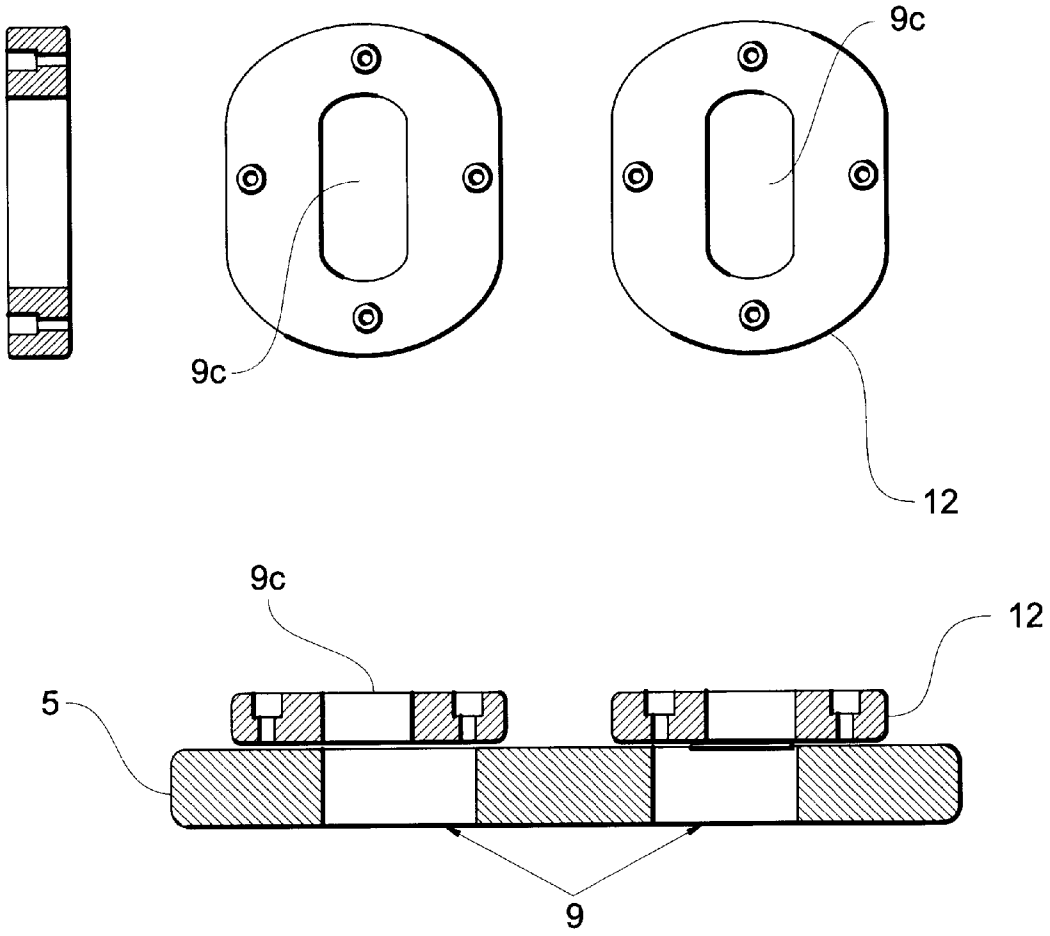
FIG. 3 shows the module and stair.
Figure 4:
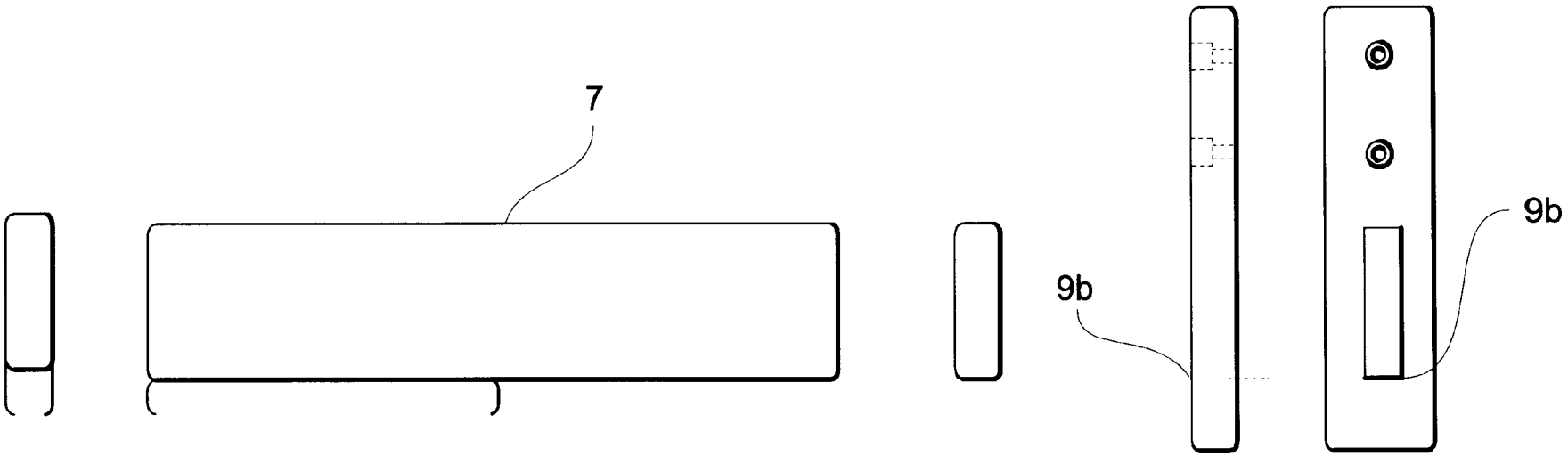
FIG. 4 shows the crosspiece and vertical piece.
Figure 5:
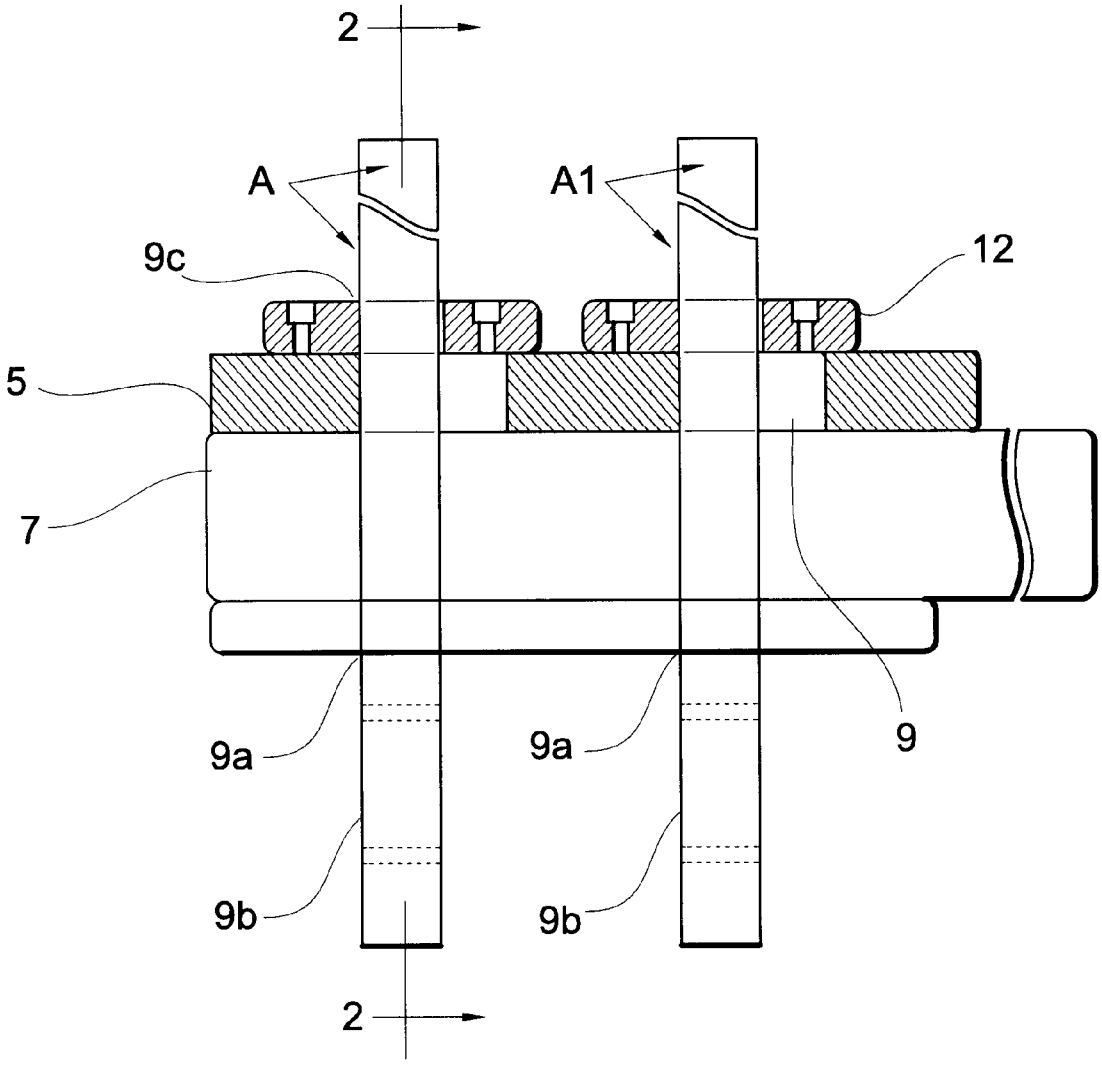
FIG. 5 is a cross-sectional view taken through the module and stair.

Stairs (5, 16) (FIGS. 1, 3) are perforated at each of their extremities with holes (9, 15), which may be rectangular with rounded angles, allowing for the passage of vertical pieces (3B, 4A, 4A1) which transfix them while leaving free access to slits (9*a*, 9*b*).

The said slits may be rectangular with rounded angles.

Figure 2:
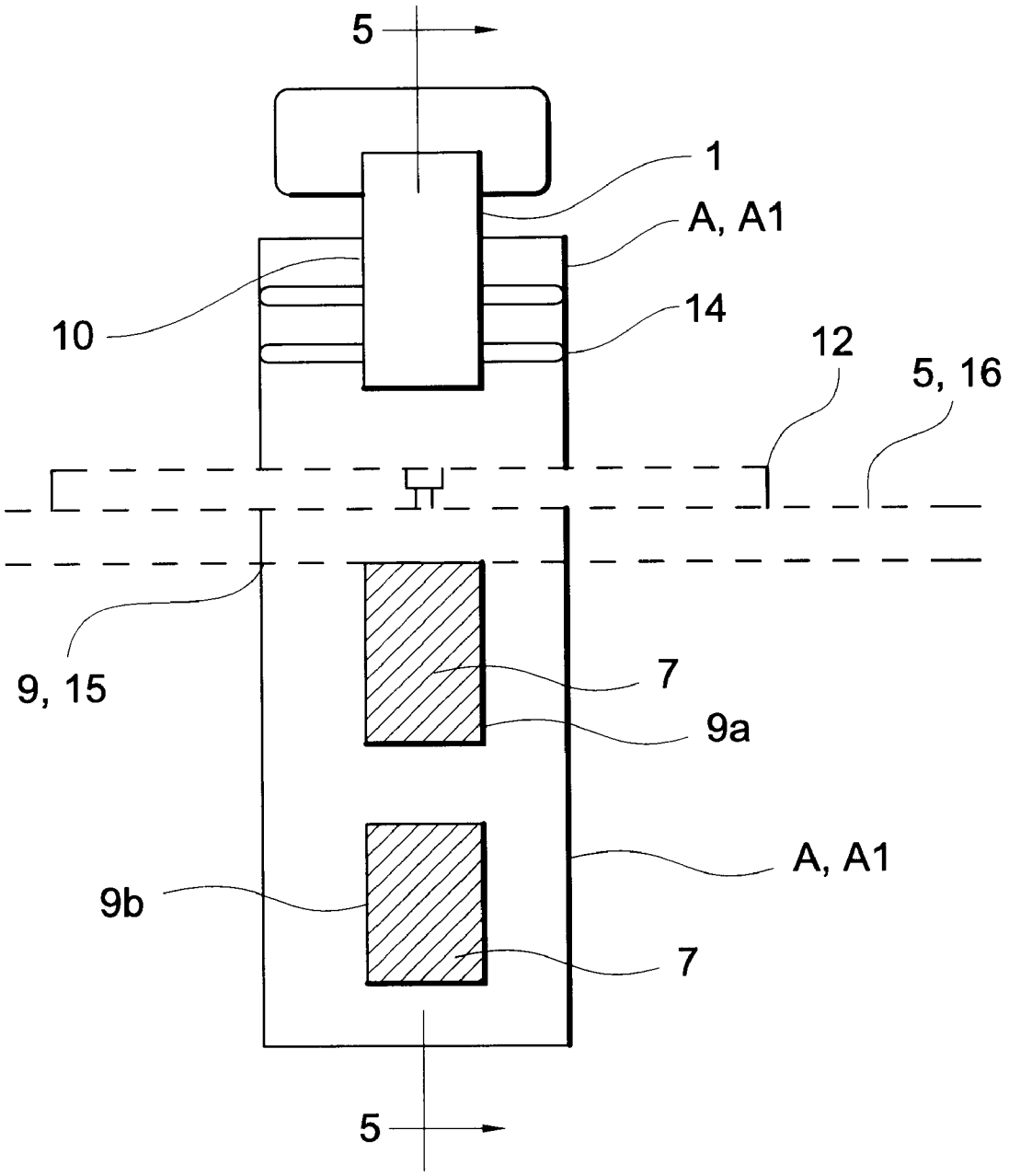
FIG. 2 is a cross-sectional view taken through vertically-spaced crosspieces.

(Slit 9*b*) is provided for in order to receive the part of crosspiece (7*a*) or of crosspiece (7) equipped with its shim (6) which has the greatest height. The part of crosspiece (7), (7*a*) which has the smallest height is designed to be inserted into slit (9*b*) (FIGS. 1, 2).

In each stair (5) or (16) have been contrived holes (9) or (15) of which the treadwise dimension is greater than the treadwise dimension of the vertical pieces (4A, 4A1) going through the holes (9), or of (3B) going through the holes (15). This arrangement combined with the possibility for sliding crosspieces (7, 7*a*) in the slits (9*a*, 9*b*) allows for the adjustment of vertical pieces (4A, 4A1) or (3B) with respect to stairs (5) or (16), to crosspieces (7, 7*a*) and to the shims (6). This allows obtaining inter alia the adjustment of the tread of the stairs. It is possible to modify the horizontal space between the vertical pieces (4A) and (4A1) of each stair.

Peripheral modules (12, 12A), which include a hole (9*c*) through which pass vertical pieces (4A, 4A1, 3B) slide and come to rest on each one of the components traversing the stairs (5, 16). The geometry of these peripheral modules allows for concealing the holes (9, 15) of the stairs.

At least one stair of the present invention includes on its upper surface, a system which makes it partially or totally nonskid.

The rear of the stair has a relief which serves as a stop to prevent the foot from going further.

Reference is made here to the aforementioned drawings to describe the advantageous, but non-limiting, embodiment of the staircase according to the invention.

Other embodiments of this staircase, of which the line of stride may have curves and/or broken lines, are possible according to the present invention.

I claim:

1. A modular and adjustable staircase for being installed between floor levels of different heights, and including stairs allowing passage from one level to the other, said staircase comprising:

(a) a rail stiffener located on at least one side of the staircase;

(b) at least one vertical piece having top and bottom ends, the top end being secured to the stiffener and the bottom end extending downwardly towards the stairs and having at least one crosspiece-receiving opening therein; and (c) a stair-supporting crosspiece with an enlarged heel received within the opening of said vertical piece, said heel determining the relative height of a stair supported by said crosspiece.

2. A staircase according to claim 1, wherein the vertical distance between each of the stairs is constant by the aid of the crosspiece and said heel.

3. A staircase according to claim 1, wherein the vertical piece includes upper and lower crosspiece-receiving openings formed in said bottom end for receiving respective first and second crosspieces.

4. A staircase according to claim 3, wherein the upper opening in the vertical piece has a greater height than the lower opening.

5. A staircase according to claim 1, wherein each stair has an enlarged opening formed adjacent a side edge thereof for allowing passage of the vertical piece which joins the stiffener to the crosspiece.

6. A staircase according to claim 5, and including a peripheral module residing adjacent each of said stairs and having an opening therein and receiving the vertical piece therethrough, said module being of a size and shape sufficient to conceal the enlarged opening of each of said stairs, and said module cooperating with fasteners to immobilize the stairs on the crosspiece.

7. A staircase according to claim 1, wherein a tread surface of the stair is adjustable by sliding the vertical piece and crosspiece forwardly or rearwardly relative to the stair.

8. A staircase according to claim 1, wherein at least one of the stairs has a non-skid upper surface.

9. A staircase according to claim 1, and comprising a relief located at a rear edge of the stair for providing a stop.

10. A modular and adjustable staircase for being installed between floor levels of different heights, and including stairs allowing passage from one level to the other, said staircase comprising:

(a) a rail stiffener located on at least one side of the staircase;

(b) at least one vertical piece having top and bottom ends, the top end being secured to the stiffener and the bottom end extending downwardly towards the stairs and having at least one crosspiece-receiving opening therein;

(c) a stair-supporting crosspiece received within the opening of said vertical piece; and (d) a shim positioned within the opening of said vertical piece between the crosspiece and a bottom surface of the opening for adjusting the relative height of a stair supported by said crosspiece.

11. A staircase according to claim 10, wherein the vertical distance between each of the stairs is constant by the aid of the crosspiece and shim.

12. A staircase according to claim 10, wherein the vertical piece includes upper and lower crosspiece-receiving openings formed in said bottom end for receiving respective first and second crosspieces.

13. A staircase according to claim 12, wherein the upper opening in the vertical piece has a greater height than the lower opening.

14. A staircase according to claim 10, wherein each stair includes an enlarged opening formed adjacent a side edge thereof for allowing passage of the vertical piece which joins the stiffener to the crosspiece.

15. A staircase according to claim 14, and including a peripheral module residing adjacent each of said stairs and having an opening therein and receiving the vertical piece therethrough, said module being of a size and shape sufficient to conceal the enlarged opening of each of the stairs, and said module cooperating with fasteners to immobilize the stairs on the crosspiece.

16. A staircase according to claim 10, wherein a tread surface of the stairs is adjustable by sliding the vertical piece and crosspiece forwardly or rearwardly relative to the stairs.

17. A staircase according to claim 10, wherein at least one of the stairs has a non-skid upper surface.

18. A staircase according to claim 10, and comprising a relief located at a rear edge of each of the stairs for providing a stop.

* * * * *

UNITED STATES PATENT AND TRADEMARK OFFICE

CERTIFICATE OF CORRECTION

PATENT NO. : 5,907,935

DATED : June 1, 1999

INVENTOR(S) : Elena

It is certified that error appears in the above-indentified patent and that said Letters Patent is hereby corrected as shown below:

Column 4, line 3, delete "stairs" and insert --stair--.

Column 4, line 47, delete "stairs" and insert --stair--.

Column 4, line 50, delete "stairs" and insert --stair--.

Signed and Sealed this

Twenty-third Day of November, 1999

*Attest:*

Q. TODD DICKINSON

*Attesting Officer*

*Acting Commissioner of Patents and Trademarks*